United States Patent [19]

Bockmiller

[11] Patent Number: 4,984,400

[45] Date of Patent: Jan. 15, 1991

[54] CLEAN ROOM CHANNEL WALL SYSTEM

[76] Inventor: Douglas F. Bockmiller, 914 Aquarius Way, Oakland, Calif. 94611

[21] Appl. No.: 434,175

[22] Filed: Nov. 13, 1989

[51] Int. Cl.[5] ..... E04H 1/00

[52] U.S. Cl. ..... 52/241; 52/235; 52/775

[58] Field of Search ..... 52/241, 235, 297–299, 52/775

[56] References Cited

U.S. PATENT DOCUMENTS

| | | | |
|---|---|---|---|
| Re. 28,408 | 5/1975 | Nelsson | 52/241 |
| 2,079,,635 | 5/1937 | Sharp | 52/241 |
| 3,038,568 | 6/1962 | Morgan | 52/241 |
| 3,058,552 | 10/1962 | Barss, Jr. | 52/241 |
| 3,061,895 | 11/1962 | Kleinhans | 52/241 |
| 3,226,207 | 8/1966 | Birum, Jr. | 52/235 |
| 3,340,663 | 9/1967 | Collard | 52/775 |
| 3,503,166 | 3/1970 | Nakazawa, et al. | 52/241 |
| 3,593,475 | 7/1971 | LaGue | 52/241 |
| 3,720,026 | 3/1973 | Gasteiger | 52/241 |
| 3,995,402 | 12/1976 | Parenteau | 52/241 |
| 4,015,390 | 4/1977 | Howorth | 52/235 |
| 4,608,066 | 8/1986 | Cadwell | 52/241 |
| 4,619,095 | 10/1986 | Johnston | 52/241 |

*Primary Examiner*—Richard E. Chilcot, Jr.
*Assistant Examiner*—Deborah McGann Ripley

[57] ABSTRACT

A non-progressive clean room wall assembly comprising an extruded framing member as a means of joining panels, and framing windows and doors. Each framing member has an elongated body with front and back side. The front side being seamless to prevent particulate accumulation, with wall panel support flanges to hold wall panels, window panels, or doors. Glazing spline is inserted into receptor grooves on the side to secure the panels in place. The back side of the framing member has a channel shaped utility chase area to hold fittings which secure the framing member to the floor or ceiling or another framing member, as well as attaching mechanical and electrical equipment. A channel closure strip may be inserted into the utility chase area to form a double wall system with two equal front sides whose flanges hold a thicker double wall panel. Both single wall and double wall assemblies may be installed and demounted from the back, outside the clean room environment. Modifications are made to the front surface of the framing member to form inside and outside corners.

11 Claims, 5 Drawing Sheets

CLEAN ROOM CHANNEL WALL SYSTEM

BACKGROUND—FIELD OF THE INVENTION

The invention relates to a wall panel assembly designed for use in clean room environments, and particularly to a framing member designed for use without screws, rivets, or welding, although it should be understood that such fastening techniques may be used within the scope of this invention.

BACKGROUND—DESCRIPTION OF PRIOR ART

With the continuing need for cleaner environments for the quality production of many semi-conductor, biotech, and aerospace products, as well as laboratory and medical procedures, the construction of the production/procedure rooms (clean rooms) becomes of utmost concern.

Heretofore, most clean room wall assemblies were simply modifications of typical wall construction, using typical wood or metal framing members where screwing of panels or panel attachments to the framing member was necessary. These methods of penetrating a material at the jobsite create dust and particulate, promoting contamination of the area. Some assemblies must be installed and demounted from within the clean room area further increasing the risk of contamination, while others are progressive assemblies requiring panels to be installed consecutively. All of these assembly types restrict the changes that can be made as the system is installed, or after installation when contamination of an active clean room would be especially detrimental. These prior assemblies are typically complicated systems requiring many parts, which not only results in high labor and material costs, but inventory problems and difficulty in designing and bidding such assemblies.

The present invention overcomes the above disadvantages by providing a clean and simple, non-progressive wall assembly that is easily installable or demountable from the back to prevent contamination of the clean room. The assembly is flexible for last minute changes and may be used for framing around irregular shapes, easing problems when dealing with out of square.

The wall panel assembly having a front and back side, includes a framing member with corresponding front and back sides. The framing member is comprised of an elongated body with at least one wall panel support flange extending lateral to the side of the body of the framing member, that acts to support wall panels, window panels and doors. The framing member is a unitary extrusion, therefore no seams to trap dust or particulate exist. The back side of the framing member has a channel shaped utility chase area for assembly of the wall system, as well as attachment of mechanical and electrical equipment. There are means of securing the wall panel up against the wall panel support flange of the framing member from the back side of the wall panel assembly. The preferred means of securing the wall panel in a single sided wall assembly is with glazing spline inserted into a glazing spline receptor located on the side of the framing member behind the wall panel. The framing member may also be used in double sided wall and double side window applications. Here, a channel closure strip with wall panel support flanges is inserted into the utility chase area to hold a wall panel against the wall panel support flanges of the framing member.

The framing member may be modified to form inside and outside corners when the front has two perpendicular surfaces that form acute or obtuse angles.

Readers will find other advantages of the invention from a consideration of the ensuing description and the accompanying drawings.

DRAWING FIGURES

Figure 4:
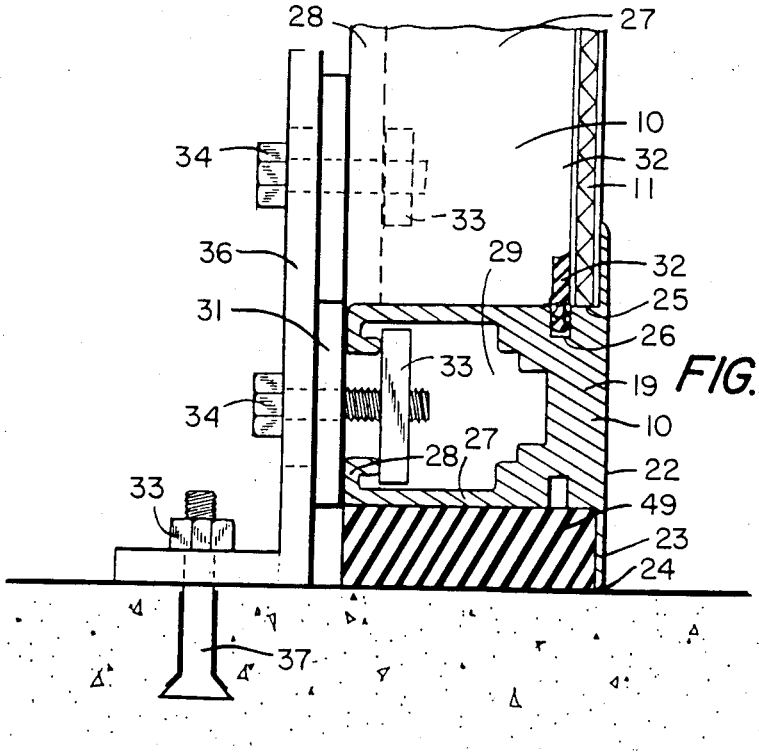

FIG. 4 a vertical cross section where a vertical post is perpendicularly fixed to the floor and the connection there with a horizontal beam.

Figure 5:
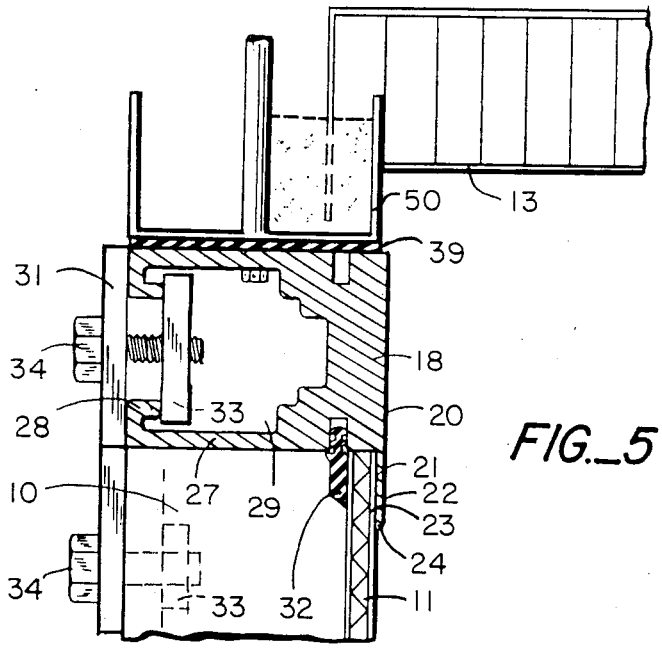

FIG. 5 shows a vertical cross section where a vertical post intersects with a modified horizontal framing member at the ceiling attachment.

Figure 6:
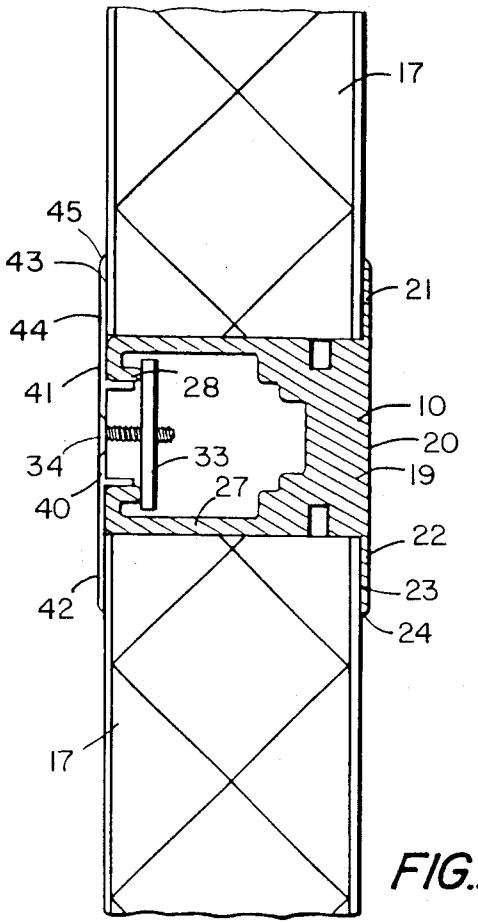

FIG. 6 shows a horizontal cross section through a double sided wall application at a vertical post.

Figure 7:
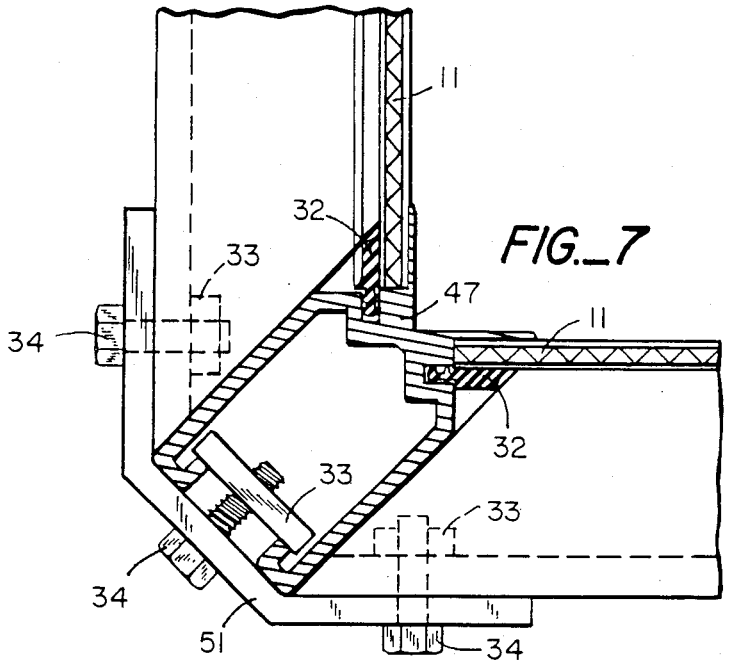

FIG. 7 shows a horizontal cross section through an inside corner framing member.

Figure 8:
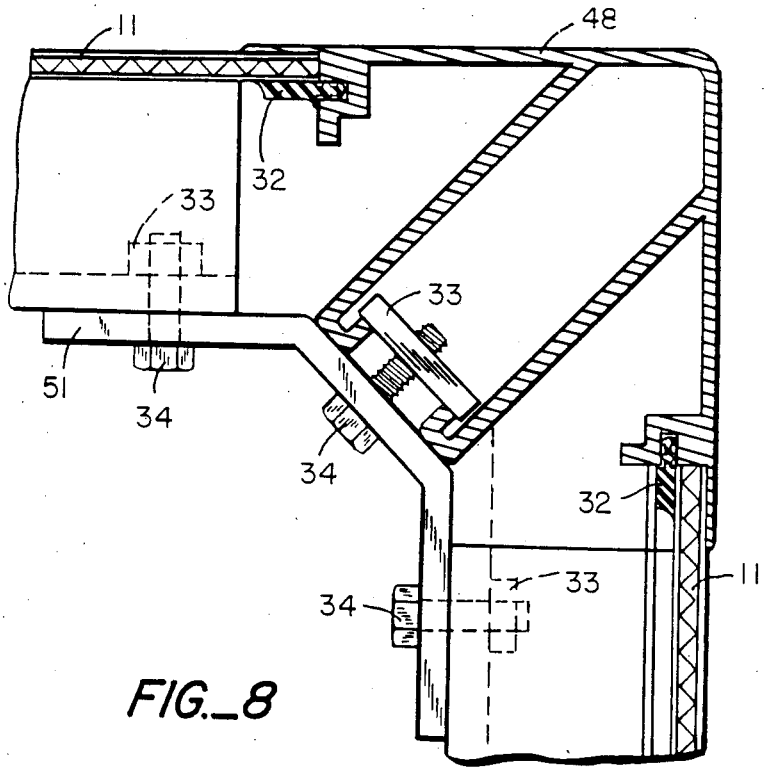

FIG. 8 shows a horizontal cross section through an outside corner framing member.

DETAILED DESCRIPTION OF AN ILLUSTRATIVE EMBODIMENT

Figure 1:
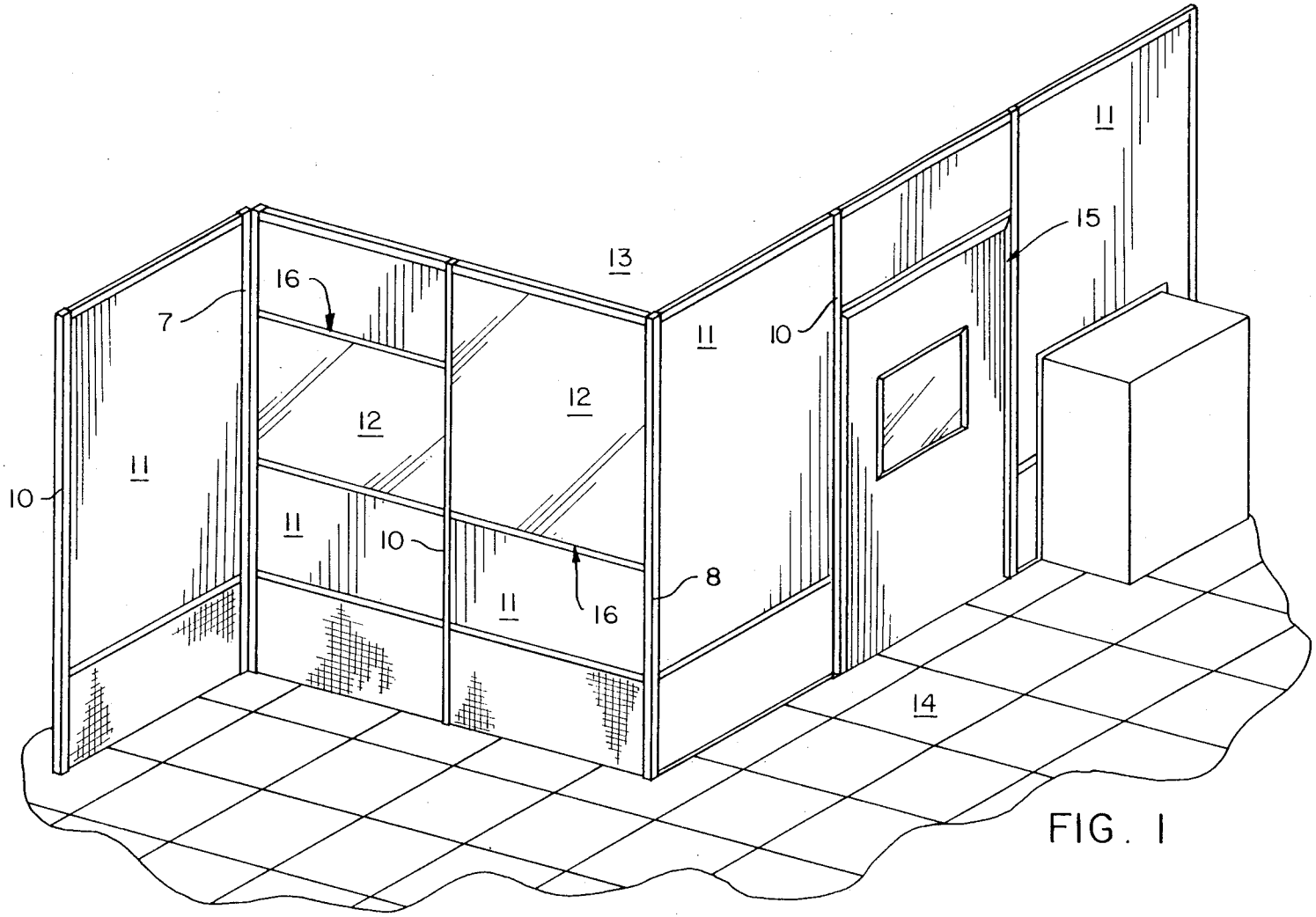
FIG. 1 shows a pictorial view of a modular wall construction embodying features of the present invention.
Figure 2:
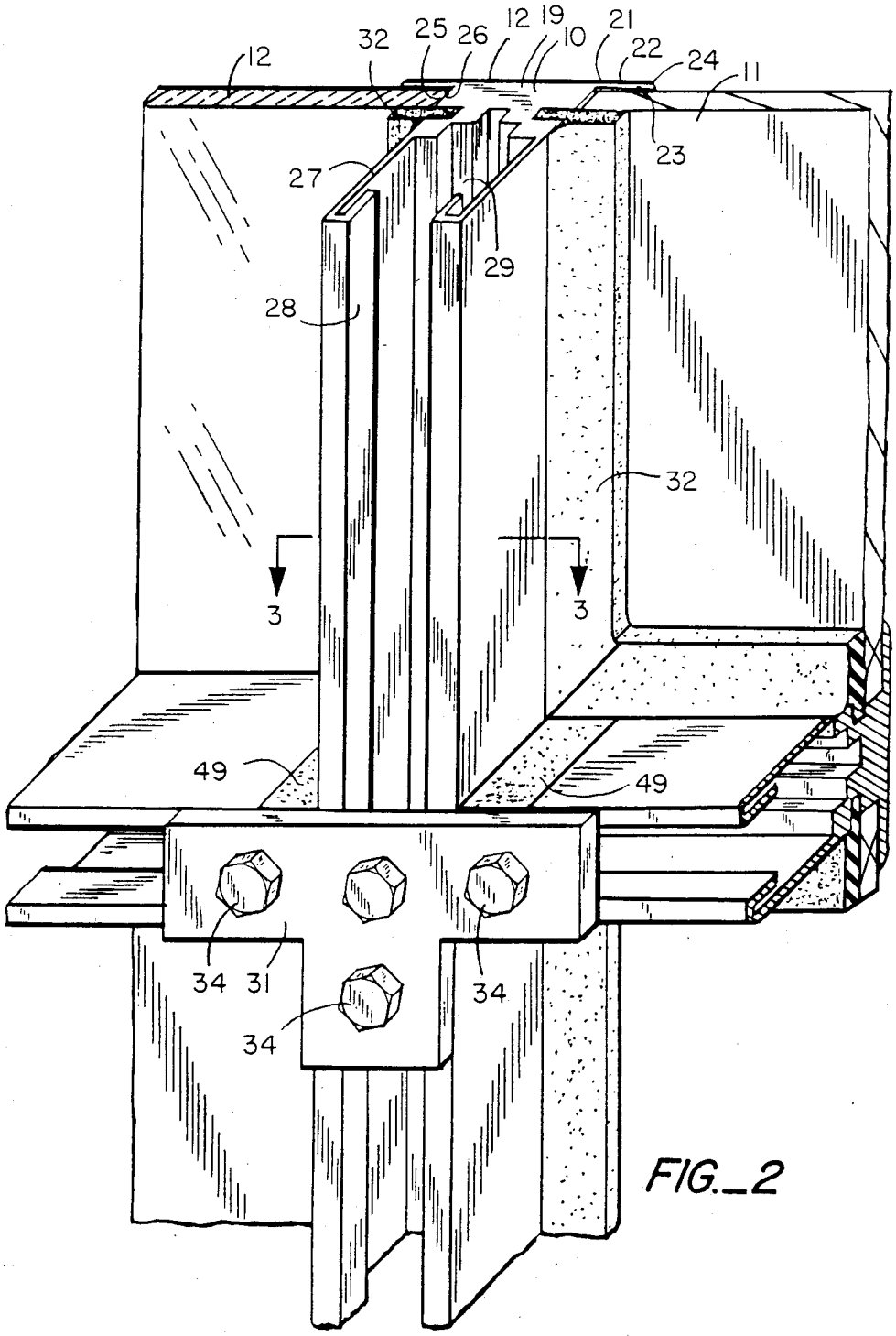
FIG. 2 shows a fragmentary diametric view of the framing member according to the invention, where a horizontal beam meets a vertical post.

Referring now in detail to the illustrative preferred embodiment depicted in the accompanying drawings, there is shown in FIG. 1 a portion of a modular wall construction embodying various features of the present invention. The wall construction comprises opposed panel members 11 and 12 defining opposite wall surfaces extending from floor 14 to ceiling 13 and meet to form inside 7 and outside 8 corners. This modular construction can also include door frame assemblies 15 and window assemblies 16 as desired. In FIG. 2 a single wall construction is shown comprising opposed panel members 11 and 12 defining a wall surface held in planar position by the framing member 10. In accordance with this invention, a plurality of framing members 10 are secured to the floor 14 and the ceiling 13 or braced to 13, in parallel position and held in place with standard mechanical/electrical fittings. The framing member, a unitary extrusion of aluminum, or other non-ferrous material, has an elongated body 19 with a front side and back side and a seamless face surface 20 that extends into lateral wall panel support flanges 21 that run longitudinally down the framing member 10. Each wall panel support flange 21 has a front surface 22 that is exposed into the clean room environment, and a rear surface 23 outside the clean room environment. The front surface 22 has a radius edge 24 that prevents dust and particulate from accumulating. The rear surface 23 meets perpendicularly with the panel butt surface 25. The wall panel 11 rests against the rear surface 23 and the panel butt surface 25 and is then held in place with glazing spline 32 which tightly into the glazing spline receptor groove 26. The panel butt surface 25 may vary in width according to the width of the panel 11 required. It should be understood from FIG. 2 that the framing member 10 can extend horizontally as a beam as well as vertically. When a horizontal beam is required, the horizontal framing member is connected to the vertical framing member in planar position and held in position with standard mechanical/electrical fittings such as 31 that are fastened in place with nuts 33 and bolts 34. Behind the intersection line between the wall panel support flange 21 of the vertical member and the face 20 of the horizontal member, an air sealing gasket 49 is inserted to seal the seam to light and air passage. It should be apparent to the reader that all work may be done from the back side of the system outside the clean room area.

The parallel legs 27, each having an edge joined on the back side of the framing member body, projecting perpendicular to the face 20 of the framing member 10 form a channel shaped utility access area and give the framing member load bearing strength. The U-shaped mechanical receptor arms 28 on the inside surfaces of legs 27 form the utility chase area 29 which accepts the fittings that attach the framing members consecutively or perpendicularly in planar position. The utility chase area 29 includes all area located between the parallel legs 27. This area may be reduced to provide increased support strength when required.

Figure 3:
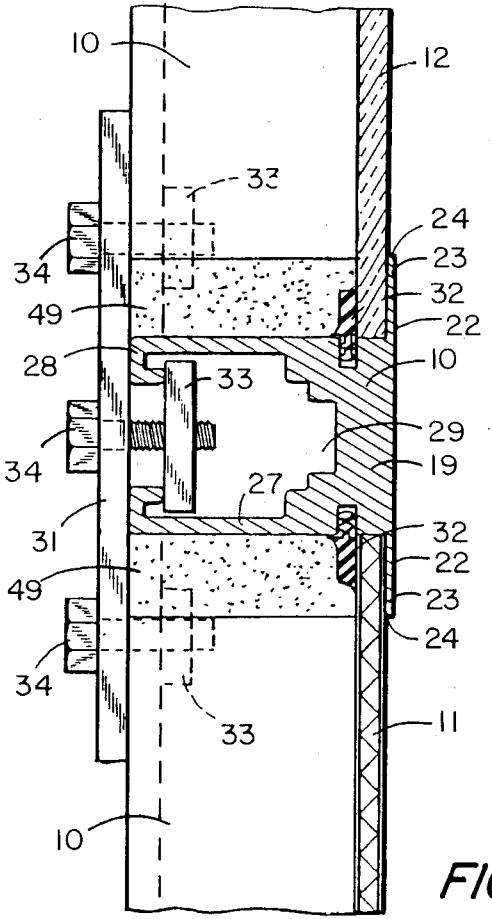
FIG. 3 shows a vertical cross section at the intersection of a vertical post and horizontal beam where an opaque panel and window panel are held by the invention.

FIG. 3 shows a cross section perspective of the invention in a similar application to FIG. 2. From this perspective one can see the method by which the panels are held in a planar position to the front surface 22 of the framing member, making for a flush inner room wall surface, with a minimal number of seams thereby reducing the possibility of particle accumulation. In this application a T-shaped fitting 31 is used to connect the horizontal and vertical framing members 10. Bolts 34 are passed through the pre-drilled holes of the fitting 31 and into nuts 33 placed within the utility chase area 29. When the bolts 34 are tightened, the nuts 33 are pulled and held into place against the receptor arms 28. This method of joining framing members squares the framing members and pulls the face ZO into a flush position automatically.

An attachment is seen in FIG. 4 of a vertical framing member 10 to the floor 14 with a right angle fitting 36. A horizontal framing member 10 may be called for at the point of contact with, or just above the floor 14 in which case the vertical and horizontal framing members would be attached as in FIG. 3 and then a slotted right angle fitting 36 would be used in conjunction with the 31 fitting and attached to the floor 14 by means of an anchor bolt 37. This method of attachment allows the horizontal member adjustability to compensate for an irregular floor.

FIG. 5 shows a typical single wall attachment of the invention to a ceiling grid 13. A modified horizontal framing member 18 is shown in which one of the wall panel support flanges 21 has been removed and forms a continuous header fastened to a ceiling grid or a filter grid 50. The seam between the ceiling and modified horizontal beam 18 is sealed with closed-cell neoprene tape 39. The vertical framing member 10 is then attached to the modified horizontal framing member 18 as in FIG. 3.

As seen in FIG. 6 the utility chase area 29 can also act as a receptor for the channel closure strip 40. This closure strip 40 has a face 41 that is formed equally to the face 20 of the framing member 10 with wall panel support flanges 42 extending laterally to the face 20 and running longitudinally along the length of 40. There is a front surface 43 of the wall panel support flange 42 which has a radius edge 45 to reduce dust and particulate accumulation and a rear surface 44 to hold the thicker double wall panel 17 in place against the rear surface 23 of 10. The channel closure strip 40 is extruded of aluminum or other non-ferrous material. It is attached with nuts 33 and bolts 34 passed through pre-drilled holes or may be snapped in when the fingers 46 are extruded longer to pass farther into the utility chase area 29 with laterally extending ridges that run longitudinally down the outer edge of the finger 46 and hold tightly against the receptor arms 28.

In FIG. 7 an inside corner variation of the invention is featured. A unitary extrusion of a non-ferrous material forms the inside corner framing member 47 with two perpendicular wall panel support flanges forming the acute angle of the face surfaces. The inside corner framing member 47 receives a panel behind the wall panel support flanges which is held in place with a glazing spline inserted into the glazing spline receptor similarly to the framing member 10. The back of the inside corner framing member 47 has parallel legs extending diagonally back from the face surfaces that form a channel for attachment to the ceiling, floor and other framing members with a connection bracket 51. The outside corner 48 application shown in FIG. 8 has a similar corner bracket fitting 51 connection ability. The unitary extrusion of the outside corner has two perpendicular wall panel support flanges forming an obtuse angle of the face surfaces. Panels are held similarly to framing member 10. Both the face surfaces of the inside corner framing member 47 and the outside corner framing member 48 are seamless to prevent particulate accumulation.

From the foregoing, it is apparent that the present invention fully accomplishes its objectives.

Attachment 1

Reference Numbers:

10: Clean Room Channel Framing Member
11: Panel
12: Window
13: Ceiling
14: Floor
15: Door Frame
16: Window Assembly
17: Double wall Panel
18: Modified Framing Member
19: Body
20: Face
21: Wall Panel Support Flange
22: Front Surface—Flange
23: Rear Surface—Flange
24: Radius Edge
25: Panel Butt
26: Glazing Spline Receptor
27: Legs
28: Receptor Arms
29: Utility Chase Area
31: T-Shaped Fitting
32: Spline
33: Nut
34: Bolt
36: Right Angle Fitting
37: Anchor Bolt
39: Closed-Cell Neoprene Tape

40: Channel Closure Strip
41: Face—Channel Closure Strip
42: Flanges—Channel Closure Strip
43: Front Surface—Flange—Channel Closure Strip
44: Rear Surface—Flange—Channel Closure Strip
45: Radius Edge—Channel Closure Strip
46: Fingers
47: Inside Corner
48: Outside Corner
49: Air Sealing Gasket
50: Filter Grid
51: Bracket

I claim:

1. A framing member for supporting at least one wall panel comprising:

An elongated body having a straight front seamless face surface and having a pair of legs opposed to one another and perpendicular to said front seamless face surface;

at least one elongated panel support flange having an elongated edge joined to said elongated body thereby forming said front seamless face surface of said framing member which includes said front seamless face surface of said body contiguous with front surfaces of said flanges;

at least one elongated glazing spline normal to said leg and in close proximity to a rear surface of said panel support flange, said leg having an elongated receptor groove parallel to and operably positioned at a distance from a backsurface of said flange to securely engage said spline and permit a panel butt surface to be secured between said flange and said spline.

2. The framing member of claim 1 wherein said front seamless face surface of said framing member is flat whereby a panel secured by one said support flange to coplanar with a panel secured by said other panel support flange.

3. The framing member of claim 1 wherein said framing member is extruded of a non-ferrous material.

4. The framing member of claim 1 wherein said framing member is an aluminum extrusion.

5. The framing member of claim 1 wherein said wall panel support flange of said framing member has an elongated outside edge that is radiused contiguous with said front seamless face surface.

6. The framing member of claim 1 wherein said front seamless face surface of said body includes a first and a second elongated section each bounded by said first and second panel support flanges and meeting at an angle to form an elongated corner intermediate said support flanges whereby a panel secured to said backside of said flange is oriented at said angle with respect to another panel secured to said rear surface of said second flange.

7. The framing member of claim 6 wherein said angle is obtuse whereby said corner is an exterior corner.

8. The framing member of claim 7 wherein said angle is acute whereby said corner is an interior corner.

9. A framing member as in claim 1 which further comprises:

two straight elongated legs, each leg parallel to one another and each bounded by a straight elongated front leg edge joined to an inside surface of said body to provide a channel shaped utility access area having an open backside and bounded on three sides by inside surfaces of said legs and body.

10. A framing member as in claim 1 which further comprises:

a channel closure strip having a face with a wall panel support flanges extending laterally of said face means attached to said inside surfaces of said utility access area for securing said channel closure strip straddled across said open backside of said utility access area with one closure flange extending away from each leg whereby a panel butt surface of a panel may be secured normal to one of said legs between said front flange and one of said closure flanges.

11. A framing member as in claim 10 wherein said securing means comprises an elongated receptor arm attached to said inside surface of each leg thereby providing a shoulder against which nuts may be positioned to bolt said channel closure strip against said receptor arm.

* * * * *